US006207915B1

(12) United States Patent
Kimura

(10) Patent No.: US 6,207,915 B1
(45) Date of Patent: Mar. 27, 2001

(54) RESET MECHANISM FOR CANCELING LOCKED STATE IN A PUSH-BUTTON SWITCH

(75) Inventor: Eiji Kimura, Auburn Hills, MI (US)

(73) Assignee: Alps Electric Co., Ltd. (JP)

( * ) Notice: Subject to any disclaimer, the term of this patent is extended or adjusted under 35 U.S.C. 154(b) by 0 days.

(21) Appl. No.: 09/577,305

(22) Filed: May 24, 2000

(30) Foreign Application Priority Data

May 24, 1999 (JP) ..... 11-143426

(51) Int. Cl.[7] ..... H01H 9/24
(52) U.S. Cl. ..... 200/524; 200/318.1
(58) Field of Search ..... 200/520–524, 200/318, 318.1, 321–325, 341

(56) References Cited

U.S. PATENT DOCUMENTS 4,543,459 * 9/1985 Hayashida ..... 200/67 D
5,262,607 * 11/1993 Cummins et al. ..... 200/524
5,369,237 11/1994 Mejerl et al. ..... 200/524
5,841,085 * 11/1998 Rittinghaus et al. ..... 200/16 R

* cited by examiner

*Primary Examiner*—Michael Friedhofer
(74) *Attorney, Agent, or Firm*—Brinks Hofer Gilson & Lione

(57) ABSTRACT

A push-button switch comprising cases, a slide member disposed movably in the cases, a heart-shaped cam groove formed in the slide member, and a locking pin for locking the slide member in a depressed position in cooperation with the heart-shaped cam groove, wherein the slide member is provided with a movable member movable in a direction orthogonal to the moving direction of the slide member, part of the heart-shaped cam groove is formed on one end side of the movable member, a drive portion is formed on an opposite end side of the movable member, and by operating the drive portion the movable member is moved to release the locking pin from the locking position.

5 Claims, 3 Drawing Sheets

RESET MECHANISM FOR CANCELING LOCKED STATE IN A PUSH-BUTTON SWITCH

BACKGROUND OF THE INVENTION

1. Field of the Invention

The present invention relates to a structure of a self-locking (single-acting) type push-button switch and more particular to a structure of a push-button switch having a reset mechanism for canceling a locked state.

2. Description of the Prior Art

According to a conventional push-button switch of a self-locking (single-acting) type, an operating portion (a slide member) is locked in a predetermined position when depressed first and is unlocked and returns to its initial position when depressed next. If another switch is operated in a locked state (circuit ON) of the push-button switch, for example in case of simultaneous locking (circuit ON), there occurs a circuit-related problem. Due to this problem, when the push-button switch must be returned to its reset position (initial position), it is necessary that the operating portion which has first been locked in its locking position be canceled its locked state by a second depressing operation.

As other push-button switches than the self-locking type there are known interlocking type push-button switches and interlocking/single-acting type push-button switches (when one operating portion, out of two operating portions, is in an unlocked state, the other operating portion performs a single-acting operation involving repeated locking and unlocking operations, and when one operating portion is in a locked state, the other operating portion performs an interlocking operation in which the other operating portion cancels the locked state of the locked one operating portion and the other operating portion itself is locked) However, these known types require the use of two or more push-button switches, resulting in complicated structures and increase of cost.

As a self-locking type push-button switch having a reset mechanism for canceling a locked state there is known a self-return type push-button switch using solenoid. In this self-return type push-button switch, the solenoid is energized with an operating portion locked in a locked position, so that the locked state of the locking portion, which is locked mechanically, is cancelled by utilizing an attractive force of the solenoid.

In the above structure of the conventional self-lock type push-button switch, however, for returning the operating portion which has first been locked in its locking position to its reset position (the initial position), it is necessary to perform the second depressing operation. Therefore, when the locked state of this push-button switch must be canceled at the time of operating another switch, the associated operation has so far been troublesome.

In the self-return type push-button switch using solenoid, the provision of solenoid is required separately for unlocking the operating portion, thus giving rise to the problem that the structure becomes complicated and the cost increases.

SUMMARY OF THE INVENTION

Accordingly, it is an object of the present invention to solve the above-mentioned problems and provide a structure of a push-button switch which, with a single push-button switch, permits a self-locking (single-acting) operation and which has a member capable of unlocking the push-button switch interlockedly with the operation of another switch at the time of operating the another switch and also has a reset mechanism for canceling a locked state.

For solving the above-mentioned problems, according to the present invention, in the first aspect thereof, there is provided a push-button switch comprising a case, a slide member disposed movably in the case, a heart-shaped cam groove formed in the slide member, and a locking pin for locking the slide member in a depressed position in cooperation With the heart-shaped cam groove, wherein the slide member is provided with a movable member movable in a direction orthogonal to the moving direction of the slide member, part of the heart-shaped cam groove is formed on one end side of the movable member, a drive port ion is formed on an opposite end side of the movable member, and by operating the drive portion the movable member is moved to release the locking pin from the locking position.

In the second aspect of the present invention, in combination with the first aspect, the case is provided with a reset mechanism for unlocking the locking pin, and the drive portion is operated by the reset mechanism, thereby moving the movable member to release the locking pin from the locking position.

In the third aspect of the present invention, in combination with the second aspect, the reset mechanism comprises a reset lever disposed movably in the case and a return spring for urging the reset lever, the reset lever being formed at one end thereof with an operating piece portion which is brought into abutment against the drive portion to actuate the drive portion and is formed at the opposite thereof with an operating lever portion which is projected outwards of the case and is operated.

In the fourth aspect of the present invention, in combination with the third aspect, the reset lever is urged in the direction orthogonal to the moving direction of the slide member by means of the return spring.

In the fifth aspect of the present invention, in combination with the first aspect, part of the heart-shaped cam groove formed on one end side of the movable member is pushed out from the heart-shaped groove formed in the slide member by operation of the drive portion, whereby the locking pin locked in the locking position is pushed out from the heart-shaped cam groove and is unlocked.

DETAILED DESCRIPTION OF PREFERRED EMBODIMENTS

Figure 1:
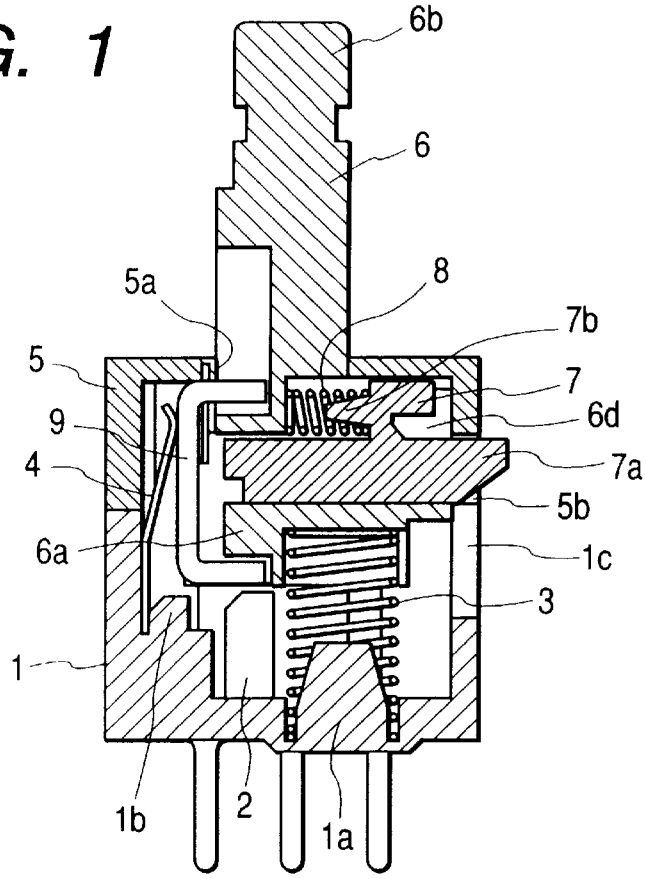
FIG. 1 is a vertical sectional view showing a structure of a push-button switch according to the first embodiment of the present invention.
Figure 2:
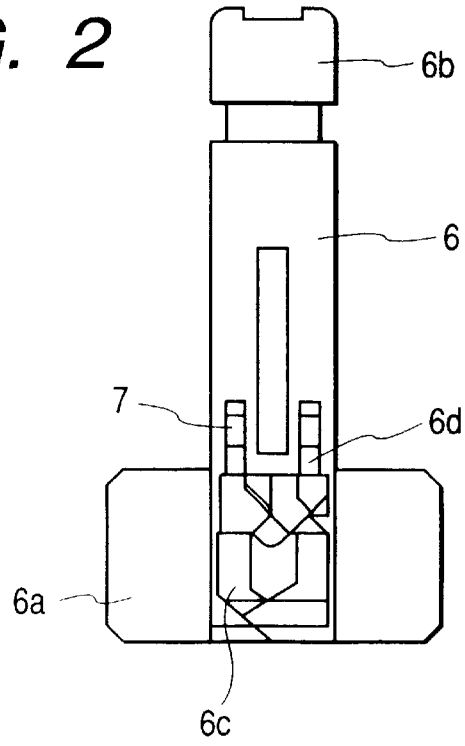
FIG. 2 is a plan view showing a slide member and a movable member both used in the push-button switch.
Figure 3:
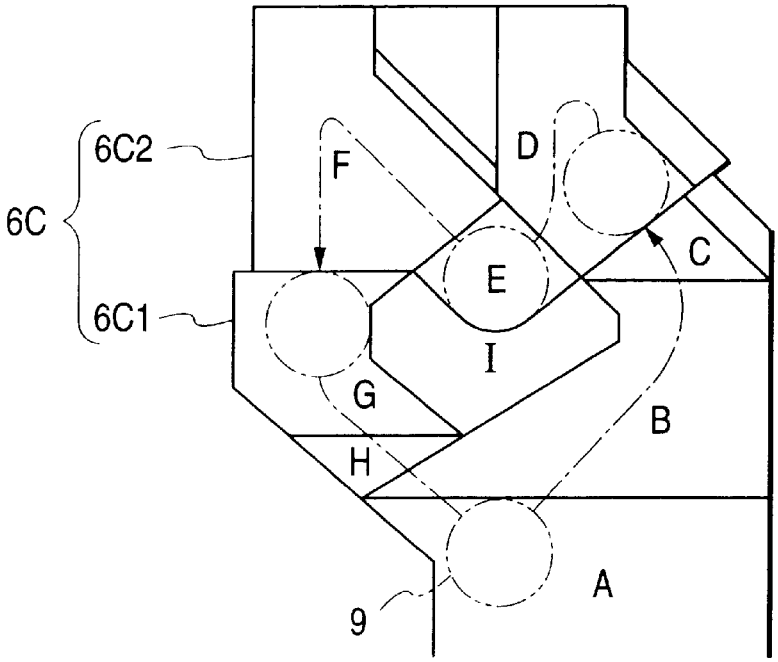
FIG. 3 is a plan view showing a heart-shaped cam groove.
Figure 4:
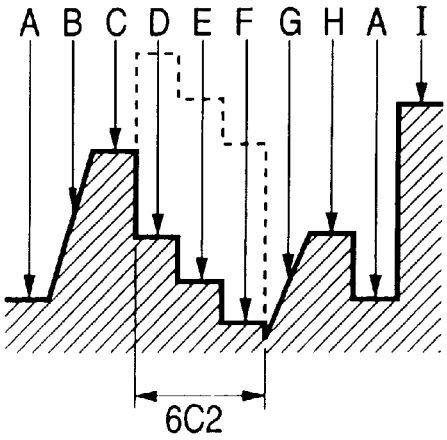
FIG. 4 is an explanatory diagram showing a stepped state of the heart-shaped cam groove.

Embodiments of the present invention are illustrated in FIGS. 1 to 6. FIGS. 1 to 4 illustrate a structure of a push-button switch according to the first embodiment of the present invention, of which FIG. 1 is a vertical sectional view of the push-button switch, FIG. 2 is a plan view showing a slide member and a movable member both used in the push-button switch, FIG. 3 is a plan view showing a heart-shaped cam groove, and FIG. 4 is an explanatory diagram showing a stepped state of the heart-shaped cam groove.

In those figures, a lower case 1 is formed in a box shape having an upper opening, using an insulating material such as a synthetic resin. On an inside bottom of the lower case 1 are formed a plurality of fixed terminals 2 side by side integrally by an insert molding for example. Also provided on the inside bottom of the lower case 1 is a return spring retaining portion la for retaining a return spring 3 which urges a slide member to be described later to a return position. At one side face of the lower case 1 is formed a holding portion 1*b* for holding a plate spring 4 which urges a locking pin to be described later toward the slide member. In the side face of the lower case 1 opposite to the holding portion 1*b* is formed a side hole 1*c* which is open outward.

An upper case 5 is formed in a box shape having a lower opening, also using an insulating material such as a synthetic resin. An insertion hole 5*a* for insertion therein of the slide member is formed in an upper surface of the upper case 5. In one side face of the upper case 5 is formed a side hole 5*b* which is contiguous to the side hole 1*c* formed in the lower case 1. The openings of the lower case 1 and the upper case 5 are coupled together in a snap-in fashion for example to constitute a case as a shell of the switch.

A slide member 6, which is formed using an insulating material such as a synthetic resin, comprises a base portion 6*a* received movably within the lower and upper cases 1, 5 and an operating portion 6*b* of a rectangular shape extending from the base portion 6*a* and projecting outward from the insertion hole 5*a*. A heart cam groove 6*c* is formed in one side face of the base portion 6*a* and a slide hole is formed contiguously to the heart cam groove 6*c* and in a direction perpendicular to a moving direction of the slide member 6. Further, the base portion 6*a* is provided with a contact piece receptacle portion 6*e* for receiving a pair of movable contact pieces (not shown) with the heart-shaped cam groove 6*c* therebetween.

A movable member 7 is formed in a generally rectangular shape using an insulating material such as a synthetic resin and is disposed so as to be movable (slidable) into the slide hole 6*d* formed in the slide member. Part of the heart-shaped cam groove 6*c* is formed on one end side of the movable member 7, while a drive portion 7*a* is formed on the opposite end side. A front end of the drive portion 7 projects outward from the side holes 1*c* and 5*b* formed in side faces of the lower and upper cases 1, 5. An upper surface of the movable member 7 is formed with a coiled spring retaining portion 7*b* to retain a coiled spring 8 with which the drive portion 7*a* of the movable member 7 is urged in a direction projecting outwards of the lower and upper cases 1, 5.

A locking pin 9 is formed by bending a linear member such as a stainless steel wire in a general U shape. One end side of the locking pin 9 is pivotably supported by the plate spring 4, while an opposite end side thereof is urged to the heart-shaped cam groove 6*c* of the slide member 6. The locking pin 9, together with the plate spring 4, is held by the lower and upper cases 1, 5 and is urged pivotally so as to trace the upper surface of the heart-shaped cam groove 6*c*.

Now, the details of the heart-shaped cam groove 6*c* will be described below with reference to FIGS. 3 and 4.

The heart-shaped cam groove 6*c* used in this embodiment is made up of nine areas A to I. A first cam groove 6*c*1 constituted by areas A, B, C, G, H, and I is formed on one side face of the base portion 6*a* of the slide member 6, while a second cam groove 6*c*2 constituted by areas D, E, and F is formed on one end side of the movable member 7. A relative height between the first and second cam grooves 6*c*1, 6*c*2 varies with movement of the movable member 7, but when the movable member 7 is not in operation, the heights of the areas A to I are in such a relation as shown in FIG. 4, with the area I being at the highest position. On the other hand, when the movable member 7 is operated, the second cam groove 6*c*2 composed of areas D, E, and F exhibits such a change as indicated with a broken line in FIG. 4, thus assuming a position higher than the area I.

The following description is now provided about the operation of the push-button switch of this embodiment.

When the opera ting portion 6*b* of the slide member 6 is depressed against the return spring 3, a relative position between the locking pin 9 and the heart-shaped cam groove changes and the lower end of the locking pin 9 traces the interior of the heart-shaped cam with the plate spring 4 as fulcrum. More specifically, as indicated with dash-double dot lines in FIG. 3, when the slide member 6 is not depressed, the locking pin 9 is engaged with the area A of the first cam groove 6*c*1 formed in the slide member 6. If the slide member 6 is depressed in this state, the locking pin 9 leaves the area A (flat surface), passes the area B (ascent surface) and area C (flat surface), then passes the area D (flat surface) of the second cam groove 6*c*2 formed on one end side of the movable member 7, and reaches the area E. In this case, since the area E is located at a lower position than the area I (flat surface) which underlies the area E in FIG. 3, the slide member 6 is locked by engagement of the locking pin 9 with the heart-shaped cam groove 6*c* in that position.

When the slide member 6 is further depressed in this locked state, the locking pin 9 shifts from area E to area F (flat surface). With subsequent rise of the slide member 6 under the urging force of the return spring 3, the locking pin 9 passes the area G (ascent surface) and area H (flat surface) and returns to area A. Thus, as the slide member 6 reciprocates, the state of contact between a movable contact piece (not shown) and any of the fixed terminals 2 changes in interlock with the reciprocating motion to change over from one to the other condition of the switch. Thus, a self-locking (single-acting) operation is performed.

A description will be given below of the case where the push-button switch is reset from a locked state thereof without direct depression of the slide member 6.

With the slide member 6 locked in its depressed position, if the drive portion 7*a* formed on the opposite end side of the movable member 7 projecting from the side holes 1*c* and 5*b* which are formed in side faces of the lower and upper cases 1, 5, is actuated in interlock with operation of an operating portion of another switch (not shown), the movable member 7 moves toward the locking pin 9 against the urging force of the coiled spring 8. When the movable member 7 is operated, the area E of the second cam groove 6*c*2 formed in the movable member assumes a projected state with respect to the area I of the first cam groove 6*c*1 formed in the slide member 6, so that the locking pin 9 which has been locked by the difference in height, or the stepped portion, between the areas I and E becomes disengaged from the stepped portion and the slide member 6 returns upward by virtue of the return spring 3 and is unlocked thereby.

In the above embodiment, the movable member 7 is provided so as to be movable in the direction orthogonal to the moving direction of the slide member 6, part of the heart-shaped cam groove 6*c* is formed on one end side of the movable member 7, while the drive portion 7*a* is formed on the opposite end side of the movable member, the drive portion 7*a* is projected from side faces of the lower and upper cases 1, 5, and the drive portion 7*a* is operated, for example, by an operating portion of another switch, whereby the movable member 7 is moved to release the locking pin 9 from the locking position. Thus, it is possible to effect a self-locking (single-acting) motion, and the locked state can be canceled by another operation, so that the operation required is no longer troublesome but becomes easy and the structure is simple, thus affording a less expensive self-lock type push-button switch.

Moreover, since locking and unlocking of the locking pin 9 are performed by the movable member 7 incorporated in the slide member 6, the difference in height of the heart-shaped cam groove 6*c*, which is for locking, can be set to a sufficient size, thereby permitting a stable self-locking (single-acting) operation.

The construction of the heart-shaped cam groove 6*c* is not limited to the one described in the above embodiment. For example, only the area E shown in FIG. 3 may be formed in the movable member 7 and the other areas may be formed in the slide member 6.

Figure 5:
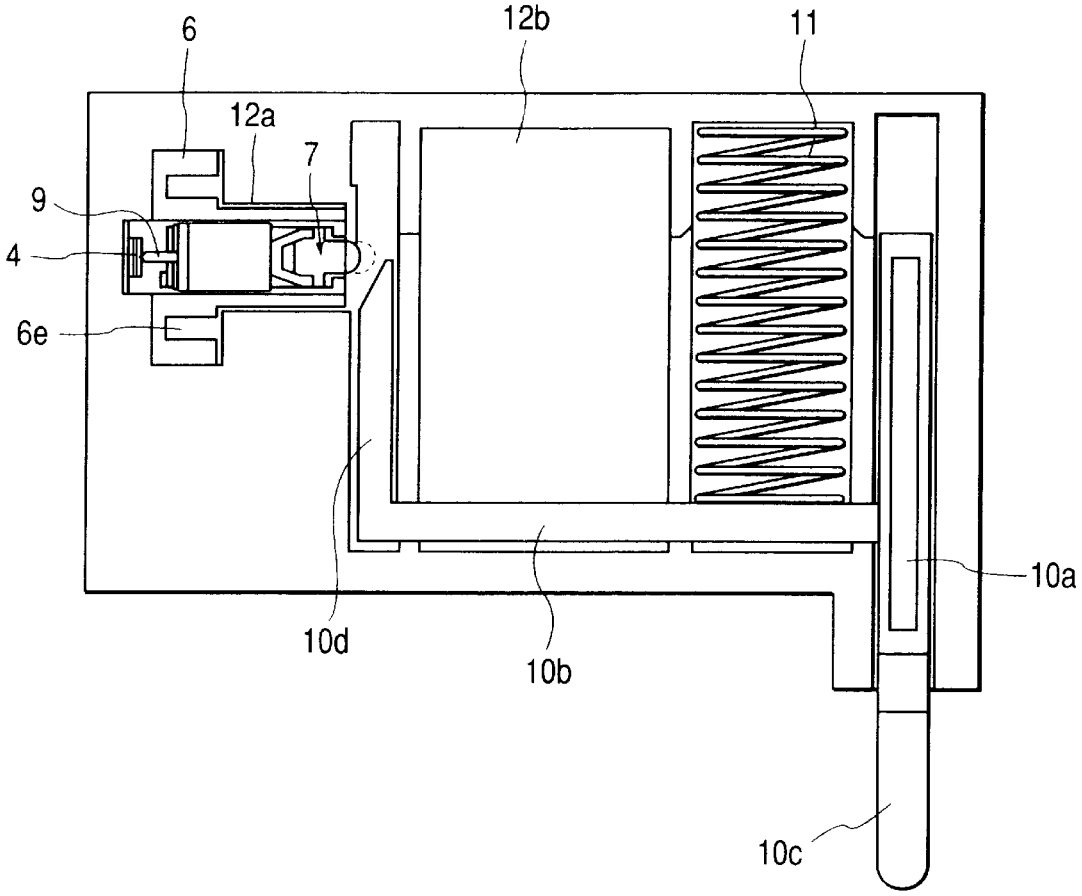
FIG. 5 is a plan view of a push-button switch according to the second embodiment of the present invention, with an upper case removed.
Figure 6:
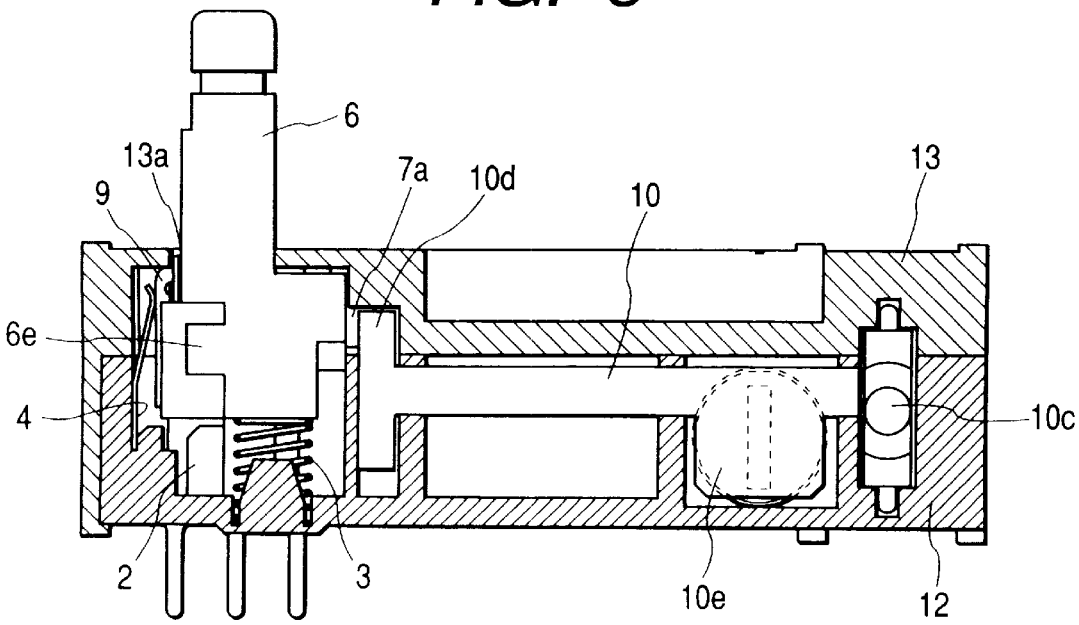
FIG. 6 is a longitudinal sectional view thereof.

FIGS. 5 and 6 illustrate a structure of a push-button switch according to the second embodiment of the present invention, of which FIG. 5 is a plan view of the push-button switch with an upper case removed and FIG. 6 is a longitudinal sectional view thereof. In both figures, the same components as in FIGS. 1 to 4 are identified by the same reference numerals as in FIGS. 1 to 4 and explanations thereof will be omitted.

This second embodiment is different from the first embodiment in that a reset mechanism is integrally incorporated in a switch case. In the push-button switch according to the second embodiment of the present invention, a reset lever 10 and a lever return spring 11 are integrally received in a switch case.

A lower case 12 is formed in a box shape having an upper opening, using an insulating material such as a synthetic resin. An opening portion 12*a* for a switch block is provided on one end side of the lower case 12, and on an inside bottom of the opening portion 12*a* are formed a plurality of fixed terminals 2 integrally side by side by insert molding for example. Further, components which constitute a switch block such as the slide member 6, return spring 3, movable member 7, coiled spring 8, locking pin 9, plate spring 4, and a movable contact piece (not shown), are received and held in the opening portion 12*a*.

A receptacle portion 12*b* for a reset mechanism is provided contiguously to the opening portion 12*a* which is for the switch block, and the reset lever 10 and the lever return spring 11 are accommodated in the receptacle portion 12*b*. The reset lever 10, which is formed of an insulating material such as a synthetic resin, is provided with an operating rod portion 10*a* as a body and a generally L-shaped operating arm portion 10*b* extending nearly centrally from the operating rod portion 10*a*. On one end side of the operating rod portion 10*a* is formed an operating lever portion 10*c* which is projected from one side face of the lower case 12. On one end side of the operating arm portion 10*b* is formed an operating piece portion 10*d* which is abutted against the drive portion 7*a* of the movable member 7 in the switch block to operate the drive portion.

Centrally of the operating arm portion 10*b* is provided a lever return spring retaining portion 10*e* with which the lever return spring 11 is engaged.

The upper case 13 is formed in a box shape having a lower opening, using an insulating material such as a synthetic resin. On one end side of its upper surface is formed an insertion hole 13*a* for insertion therein of the operating portion 6*b* of the slide member 6. The opening portions of the lower and upper cases 12, 13 are coupled together by a snap-in method for example. Thus, the switch block and the reset mechanism are accommodated within the switch case which case as a switch shell is constituted by the lower and upper cases 12, 13.

The operation of the reset mechanism used in this embodiment will now be described. As to the self-locking (single-acting) operation of the switch block, an explanation thereof will be omitted because it is the same as in the previous first embodiment.

When the operating lever portion 10*c* of the reset lever 10 is pushed with the operating portion 6*b* of the slide member 6 depressed and locked, an inclined front end face of the operating piece portion 10*d* formed on one end side of the operating arm portion 10*b* comes into abutment against the drive portion 7*a* of the movable member 7 which is provided movably in the slide member 6, and pushes in the drive portion 7*a*. At this time, the movable member 7 moves toward the locking pin 9 against the urging force of the coiled spring 8. Once the movable member 7 is operated, the area E of the second cam groove 6*c*2 formed in the movable member 7 assumes a projected state with respect to the area I of the first cam groove 6*c*1 formed in the slide member 6, so that the locking pin 9 which has been locked by the stepped portion between the areas I and E becomes disengaged from the stepped portion and the slide member 6 returns upward by virtue of the return spring 3 to cancel the locked state.

Also in this second embodiment of the present invention the movable member 7 movable in the direction orthogonal to the moving direction of the slide member 6 in the switch block is provided, part of the heart-shaped cam groove 6*c* is formed on one end side of the movable member 7, while on the opposite end side thereof is formed the drive portion 7*a*, the reset mechanism for unlocking the locking pin 9 is accommodated inside the cases 12 and 13, and the drive portion 7*a* is operated by the reset mechanism, thereby moving the movable member 7 to release the locking pin 9 from the locking position. Thus, there is obtained a push-button switch having a reset mechanism which is simple in structure and easy to operate.

Further, since the locking and unlocking of the locking pin are performed by the movable member 7 incorporated in the slide member 6, the locking stepped portion of the heart-shaped cam groove 6*c* can be set at a sufficient size, thus permitting a stable self-locking (single-acting) operation.

The configuration of the reset mechanism is not limited to the one described above. For example, the drive portion 7*a* may be operated by a rotary disc or by a slidable cam plate.

In the push-button switch according to the present invention, as set forth above, a movable member movable in the direction orthogonal to the moving direction of the slide member is provided in the slide member, part of a heart-shaped cam groove is formed on one end side of the movable member, while a drive portion is formed on the opposite end side of the movable member, and the movable member is moved by operating the drive portion to release the locking pin from the locking position, thus affording a less expensive self-locking type push-button switch of a simple structure capable of performing a self-locking (single-acting) operation, also capable of canceling a locked state by another operation, and permitting operations to be done easily without involving any troublesomeness.

Besides, a reset mechanism for unlocking the locking pin is provided in the switch case and the drive portion is operated by the reset mechanism, thereby moving the movable member to release the locking pin from the locking position, thus affording a push-button switch with a reset mechanism of a simple structure and easy to operate.

Further, the reset mechanism comprises a reset lever disposed movably in the case and a return spring for urging the reset lever, and the reset lever is formed at one end thereof with an operating piece portion abutted against the drive portion to actuate the drive portion and is also formed at the opposite end thereof with an operating lever portion which is projected outwards of the case and is operated. Thus, it becomes possible to change the shape of the reset lever, so that the design freedom of the operating lever portion increases.

Further, since the reset lever is urged in the direction orthogonal to the moving direction of the slide member, it becomes possible to thin the reset lever and hence possible to reduce the size and wall thickness of the switch body.

Further, since part of the heart-shaped cam groove formed on one end side of the movable member is pushed out from the heart-shaped cam groove formed in the slide member and the locking pin locked in the locking position of the heart-shaped cam groove formed in the slide member is released from its locked state, the locking stepped portion of the heart-shaped cam groove can be set at a sufficient size and hence it becomes possible to effect a stable self-locking (single-acting) operation.

What is claimed is:

1. A push-button switch comprising:

a case;

a slide member disposed movably in the case;

a heart-shaped cam groove formed in the slide member; and a locking pin to lock the slide member in a depressed position in cooperation with the heart-shaped cam groove, the depressed position being a locking position, wherein the slide member is provided with a movable member movable in a direction perpendicular to a moving direction of the slide member, part of the heart-shaped cam groove is formed on one end side of the movable member, a drive portion is formed on an opposite end side of the movable member, and by operating the drive portion the movable member is moved to release the locking pin from the locking position.

2. A push-button switch according to claim 1, wherein the case is provided with a reset mechanism to unlock the locking pin, and the drive portion is operated by the reset mechanism, thereby moving the movable member to release the locking pin from the locking position.

3. A push-button switch according to claim 2, wherein the reset mechanism comprises a reset lever disposed movably in the case and a return spring for urging the reset lever, the reset lever being formed at one end thereof with an operating piece portion which is brought into abutment against the drive portion to actuate the drive portion and is formed at the opposite end thereof with an operating lever portion which is projected outwards of the case and is operated.

4. A push-button switch according to claim 3, wherein the reset lever is urged in the direction orthogonal to the moving direction of the slide member by means of the return spring.

5. A push-button switch according to claim 1, wherein part of the heart-shaped cam groove formed on one end side of the movable member is pushed out from the heart-shaped groove formed in the slide member by operation of the drive portion, whereby the locking pin which is locked at a locking position of the heart-shaped cam groove is pushed out from the heart-shaped cam groove and is unlocked.

* * * * *